US011832777B2

(12) United States Patent
Klug et al.

(10) Patent No.: US 11,832,777 B2
(45) Date of Patent: Dec. 5, 2023

(54) ABSORPTIVE DRYING IMPLEMENT

(71) Applicant: DORAI HOME, INC.

(72) Inventors: Jason Charles Klug, Salt Lake City, UT (US); Aaron Basil Nelson, Salt Lake City, UT (US); Kelsey O'Callaghan, Salt Lake City, UT (US)

(73) Assignee: Dorai Home, Inc., West Valley City, UT (US)

( * ) Notice: Subject to any disclaimer, the term of this patent is extended or adjusted under 35 U.S.C. 154(b) by 0 days.

(21) Appl. No.: 16/852,208

(22) Filed: Apr. 17, 2020

(65) Prior Publication Data

US 2020/0245845 A1 Aug. 6, 2020

Related U.S. Application Data

(60) Provisional application No. 62/836,583, filed on Apr. 19, 2019.

(51) Int. Cl.
*A47L 19/02* (2006.01)

(52) U.S. Cl.
CPC ..... *A47L 19/02* (2013.01)

(58) Field of Classification Search
CPC ..... A47L 19/02
See application file for complete search history.

(56) References Cited

U.S. PATENT DOCUMENTS 4,948,079 A 8/1990 Baeta
9,730,571 B1 8/2017 Lee et al.
9,907,453 B2 * 3/2018 Green ..... A47L 19/00
2007/0131629 A1 * 6/2007 Sullivan ..... A47L 19/04 211/41.3
2008/0179264 A1 * 7/2008 Abrams ..... A47L 19/02 34/104
2009/0162596 A1 * 6/2009 Rios ..... B32B 5/245 428/141

(Continued)

FOREIGN PATENT DOCUMENTS

CN 207285978 U 1/2018
JP 3204281 U * 5/2016

OTHER PUBLICATIONS

International Search Report for PCT/US2020/028837 dated Jul. 1, 2020.

(Continued)

*Primary Examiner* — Andrew T Piziali
(74) *Attorney, Agent, or Firm* — Headland Law & Strategy; Matthew J. Smyth

(57) ABSTRACT

Drying implements disclosed herein can provide a minimal, collapsible, dish drying pad encased in woven, silicone protection for recently washed kitchenware placed thereon. Such drying implements include a rapid absorption and drying diatomaceous earth panels that causes drain water to rapidly dissipate. This helps to prevent bacteria growth, by eliminating the moist environment where mold thrives. The mesh silicone layer or encasing keeps dishes protected and the kitchen looking fresh and modern. The drying implement shows various improvements for all types of drying jobs from dishes to produce. The drying implement folds upon its connected sections for smaller jobs and for easy storage when not in use.

22 Claims, 15 Drawing Sheets

(56) References Cited

U.S. PATENT DOCUMENTS

| | | | | |
|---|---|---|---|---|
| 2009/0179446 | A1* | 7/2009 | Ahlers | A45F 4/06 294/137 |
| 2009/0211994 | A1* | 8/2009 | Yang | A47L 19/04 211/41.4 |
| 2016/0113479 | A1* | 4/2016 | Hawker | A47L 19/04 211/41.6 |
| 2016/0206176 | A1* | 7/2016 | Eilmus | A47J 47/20 |
| 2019/0374069 | A1 | 12/2019 | Klug | |

OTHER PUBLICATIONS

Written Opinion of the International Searching Authority for PCT/US2020/028837 dated Jul. 1, 2020.

* cited by examiner

ABSORPTIVE DRYING IMPLEMENT

CROSS-REFERENCE TO RELATED APPLICATIONS

This patent application claims priority to and the benefit of U.S. Provisional Patent Application 62/836,583 filed Apr. 19, 2019, the contents of which are hereby incorporated herein by reference in its entirety and for all purposes.

BACKGROUND OF THE INVENTION

FIG. 1A illustrates two conventional drying racks 1*a* and 1*b* which are generally composed either of rubber or plastic polymer (see 1*a*) or often polymer coated metal wires (see 1*b*). In use, a conventional drain tray 10 is positioned beneath the racks 1*a* and 1*b* and generally includes a central platform area 13, bounded by raised sidewalls 11, on which the racks 1*a* and 1*b* are supported. The water dripping from the racked dishes collects upon the platform area 13 of the drain tray 2, out of contact with the dishes, thereby accelerating the draining and drying of the dishes. Some drain trays 10 in common use provide an outlet channel 12 at one end of the platform area 13. The outlet channel 12, or groove, is often directed over a sink. In this way excess water collected by the drain tray 10 can be diverted into the sink. Other drain trays 10 may merely collect the water in the platform area 13, for eventual disposition by way of evaporation or manual emptying. Such conventional drying racks 1*a* and 1*b* are bulky and unappealing in appearance.

Referring to FIG. 1B, a conventional drying mat for kitchenware can include a conventional dish towel. The traditional drying mat is disposed upon a countertop for placement of recently cleaned dishes, utensils, glassware, and other kitchenware or even produce for evaporation of any remaining rinse water. As shown in FIG. 1B, some drying mats may even include a conventional towel, or other absorption mats, to absorb water from the dishes, cookware, and glassware. Some drying mats are machine washable, whether in a dishwasher in the case of dish mats made from plastic or rubberized mat; or for washing a microfiber or cotton dish mat in a traditional clothing washer, for example.

Traditional drying mats in particular have many shortcomings. For example, such traditional drying mats often become saturated or otherwise prone to accumulating moisture and bacteria. Accumulation of moisture, saturation, and bacteria is particularly distasteful in the kitchen where food is prepared and cleanliness is a health necessity. Such accumulation of moisture, saturation, and bacteria is also visually unappealing for household members as well as guests. Traditional rubber mats and dish racks are also bulky and take up space when stored and are overall visually unappealing and cumbersome.

The subject matter claimed herein is not limited to embodiments that solve any disadvantages or that operate only in environments such as those described above. Rather, this background is only provided to illustrate one exemplary technology area where some embodiments described herein may be practiced.

BRIEF SUMMARY OF THE INVENTION

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

Drying implements are disclosed herein which include a flexible layer for supporting an object while the object is drying. According to various example embodiments, such an object includes kitchenware such as cups, bowls, utensils, and glasses. However, such object can include fruits, vegetables, and other household cooking or work utilities where an object is washed or rinsed and allowed to dry.

The flexible layer is resilient and cushions the object while placed thereon, whereas the absorptive later may be substantially rigid, hard, and potentially abrasive. The flexible layer includes a series of apertures through the flexible layer allowing for liquid to drain from the drying object, through the flexible layer, and onto an absorptive layer. The drying implement further including the absorption layer disposed under the flexible layer. The absorption layer absorbing the liquid drained from the object, through the apertures of the flexible layer and onto the absorption layer. While, intervening layers and other configurations may be used, in preferred embodiments the flexible layer is disposed directly upon the absorptive layer. Furthermore, in many embodiments, the flexible layer has integrated or attached straps, end pockets, or other means for securing, and in Some cases partially surrounding, the absorptive layer.

The absorption layer can include diatomaceous earth, and the absorption layer is at least partially substantially rigid. The absorption layer can be in the form of a plurality of panels, for example three panels in some illustrative embodiments. The flexible layer can be formed from a molded polymer material. The molded polymer material can include a molded silicone material. The silicone material can have a durometer of between 30 and 60, or about 45 in some embodiments. The substantially rigid absorption layer includes at least two substantially rigid panels so as to allow the absorptive drying implement in half its elongated unfolded planar length. According to some embodiments, the substantially rigid absorption layer includes at least three substantially rigid panels so as to allow the panels to be folded into approximately a third of its unfolded planar length. Folding the absorptive drying implement may promote a decreased storage size, but also enables use of the absorptive drying implement in its folded state by using only one of the sections of absorptive drying implement while two sections are folded thereunder.

The substantially flexible layer can include a plurality of sections corresponding to a plurality of panels of the absorption layer. The sections of the substantially flexible layer are connected by one or more flexible joints. The sections of the drying implement can be foldable or collapsible.

The apertures of the substantially flexible layer include voids through a thickness thereof, an array of the apertures of the flexible layer can extend along a length and width of the flexible layer and be sized so as to be smaller than the anticipated object being dried so as to support the object thereon. The flexible layer can include one or more peripheral lips for securing the absorption layer thereto. The flexible layer can be integrally molded with one or more straps for securing the absorption layer thereto. The flexible layer can be integrally molded with one or more end pockets, sleeves, straps, VELCRO, fasteners, corner caps or other means for securing the absorption layer thereto.

A bottom surface of the absorptive layer can be exposed so as to allow evaporation from opposing surfaces of the absorptive layer. The flexible layer partially extending around the top, sides, and bottom absorptive layer. The flexible layer can include protrusions extending from the bottom of the flexible layer for supporting the absorptive layer above a counter disposed thereunder and allowing for air circulation underneath the absorptive layer which can also be exposed on both sides.

The drying implement can provide a joint between adjacent sections of the flexible layer, the joint can include an upwardly extending lip to retain water on the joint as opposed to allowing the water to spill onto a countertop when disposed thereon.

Methods of manufacturing, assembling and using a drying implement can include forming one or a plurality of rigid absorption panels. The absorption panels can comprising diatomaceous earth. The methods can further include molding a silicone rubber covering, the silicone rubber covering having an array of voids allowing for water to drain through the silicon covering. The methods can further include wrapping the silicone rubber covering around the plurality of ridged absorption panels. The silicone rubber covering flexibly connecting the ridged absorption panels such that the ridged absorption panels may be laid flat or folded so as to rest upon an adjacent panel.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Embodiments of the drying implement disclosed herein can provide an adaptable, minimal, collapsible, dish drying pad. The drying implement is encased in woven, silicone protection for recently washed kitchenware placed thereon. Such drying implements include rapid absorption and drying diatomaceous earth panels that causes drain water to rapidly dissipate. This helps to prevent bacteria growth, by eliminating the moist environment where mold thrives. The mesh silicone layer or encasing keeps dishes protected and the kitchen looking fresh and modern. The drying implement shows various improvements for all types of drying jobs from dishes to produce. The drying implement folds upon its connected sections for smaller jobs, and for easy storage when not in use.

Figure 1A:
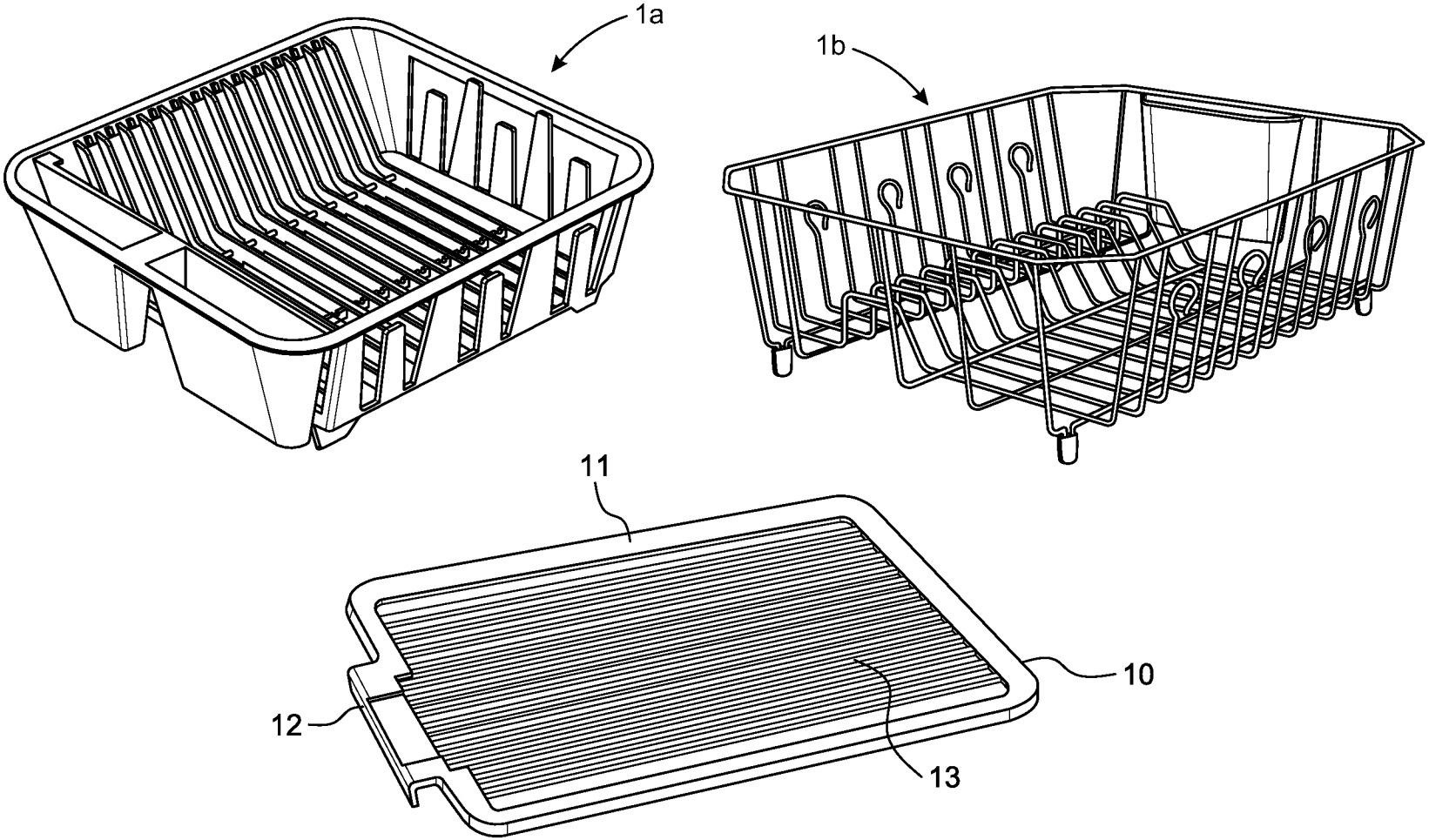
FIG. 1A (PRIOR ART)
FIG. 1A illustrates conventional drying racks according to the prior art.
Figure 1B:
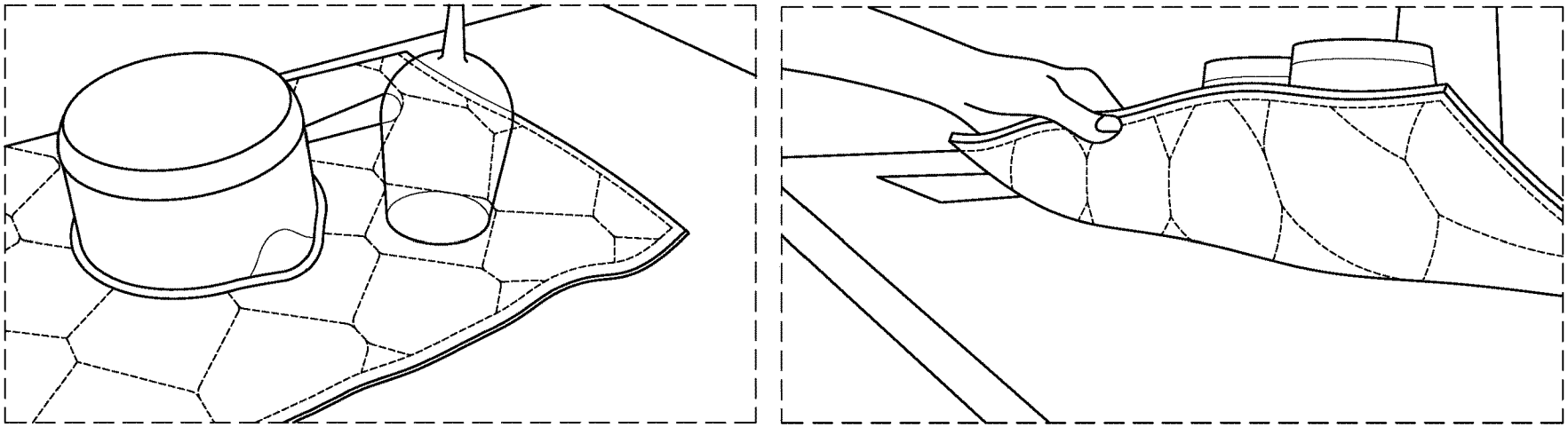
FIG. 1B (PRIOR ART)
FIG. 1B illustrates a conventional drying mat in the form of a towel or other textile with dishes placed thereupon.

The drying implement is ideal for occasions when a full rack such as those discussed in the Background with reference to FIG. 1A is not needed but simply provides a sanitary space to dry your dishes while protecting the countertop. The foldable drying implements disclosed herein provide an adaptable and affordable drying system that instantly eliminates pooling water. A silicone wrapping helps promote 360 degree air flow while protecting delicate items according to some embodiments. When finished, the drying implement can be folded and stored in even a relatively small drawer or under the sink.

Several embodiments disclosed herein relate to improvements in countertop drying mats, arrangements, or pads referred to herein as drying implements. Such drying implements can be made from a multi-layer, composite, modular, or multi-part construction or assembly. The rapid-drying absorptive countertop drying implement can include multiple layers. A first layer of the drying implement can include a wicking absorption earth element layer. A second layer of the drying implement can include a flexible, resilient, porous, and/or connective layer.

The composite parts, elements, and wicking absorptive earth element portion(s) can be assembled together with the flexible, resilient, porous, web-like connective layer to create the combined advantages of the absorptive countertop drying implement disclosed herein. The assembled drying implements may also be disassembled in some embodiments such that one or more portions thereof may be independently cleaned and/or replaced. Moreover, one or more portions, or the assembled drying implement, can be collapsible, foldable, or otherwise reducible in size or shape for improved storage or confined use.

In some advantageous embodiments, the drying implement can be foldable and/or stackable. The drying implement can include two or more substantially rigid wicking absorptive earth element portions, also referred to as panels, joined together by one or more relatively flexible joints. The joints between the substantially rigid portions can allow for the rigid portions to remain connected to adjacent portions even though the portions are folded one upon another in a stack-like fashion.

When folded, the portions of the drying implement can be disposed upon each other such that they lie parallel and vertically layered each upon another portion of the drying implement. The layers may be sequentially joined so as to be connected on opposing ends from one inner section to adjacent exterior sections and any number of connect(able) sections may bed used.

The flexible joint can be a rubber connection between adjacent wicking absorptive earth element sections. According to some embodiments, the flexible portion can be made of a flexible and resilient molded rubber or silicone layer. The flexible portion can be molded to include a plurality of voids there through for allowing water to drip through the resilient portion and onto the one or more substantially rigid wicking absorption earth element portions or panels.

As previously discussed, the drying implement can include substantially rigid segments separated by flexible joints there between. The substantially rigid segments can be due to substantially rigid absorptive diatomaceous earth element panels inserted into, attached to, or affixed to segments of the substantially flexible portion. The substantially flexible portion can be made from a cushioning silicone pad that slips around the panels of substantially rigid earth element and holds the panels together. The cushioning attributes of the flexible portion can cushion dishes and glassware placed therein and also prevent the substantially rigid panels from scratching or wearing the utensils and other kitchenware. In between the panels is one or more joint formed in the silicone pad that holds one panel to one or more adjacent panels of absorptive earth elements, such as panels made of diatomaceous earth.

Rapidly wicking and drying earth portions can include the material called diatomaceous earth. Diatomaceous earth—also known as D.E., diatomite, or kieselgur/kieselguhr—is a naturally occurring, soft, siliceous sedimentary rock that is traditionally easily crumbled into a fine white to off-white powder. It has a particle size ranging from less than 3 μm to more than 1 mm, but typically 10 to 200 μm. Depending on the granularity, this powder can have an abrasive feel, similar to pumice powder, and has a low density as a result of its high porosity. The typical chemical composition of oven-dried diatomaceous earth is 80-90% silica, with 2-4% alumina (attributed mostly to clay minerals) and 0.5-2% iron oxide.

Diatomaceous earth consists of fossilized remains of diatoms, a type of hard-shelled protist (chrysophytes). As disclosed herein the layer or component of diatomaceous earth of the mat is used as an absorbent and rapid evaporator for liquids. The thermal properties of diatomaceous earth also enable it to be used as the barrier material according to several embodiments disclosed herein.

For example, several embodiments disclosed herein include a diatomaceous earth component forming a part of the countertop drying mat. In several embodiments, the diatomaceous earth component can be a lower layer disposed underneath an upper layer having a pours, voids, slots, a web-like configuration, or other passages for liquid to flow through and be absorbed by the diatomaceous earth layer. The placement of the diatomaceous earth layer or component immediately below the mat upon which dishes, utensils, and glassware is placed allows for the diatomaceous earth to rapidly wick and absorb the moisture from the dishes, glassware, and utensils thereby rapidly removing saturation of water from the drying environment immediately adjacent the dishes, utensils and glassware. Once absorbed by the diatomaceous earth layer, the repeated saturation of the drain mat is more rapidly evaporated and dried as compared to traditional drying mats and other drain assemblies. The pours, voids, slots, and other passages through the resilient polymer portion also allows for circulation of air under the dishware, glasses, utensils, and any other clean yet wet implement for evaporation of water therefrom.

According to some embodiments, the resilient layer can be referred to as having a flexible web portion including a plurality of ribs separated by voids and passages there through so as to allow water to drip onto the substantially rigid diatomaceous earth panels. The outer periphery of the web portion can include a series of lower extending ribs that extend below the resilient layer and around the periphery of the panels when inserted therein. The ribs can include vertical locating protrusions for securing the panels of diatomaceous earth therein. Moreover, one or more straps or end caps can be disposed on an underside of the resilient layer for further securing the panels of absorptive earth elements to the underside of the resilient web layer.

The bottom side of the flexible layer can wrap around the diatomaceous earth panels and have protrusions or molded legs extending therefrom so as to lift the bottom of the implement above a countertop providing for additional circulation underneath the implement. This nearly 360 degree exposure of the diatomaceous earth panels provided for even more rapid evaporation of drain water absorbed the diatomaceous earth panels.

Figure 2:
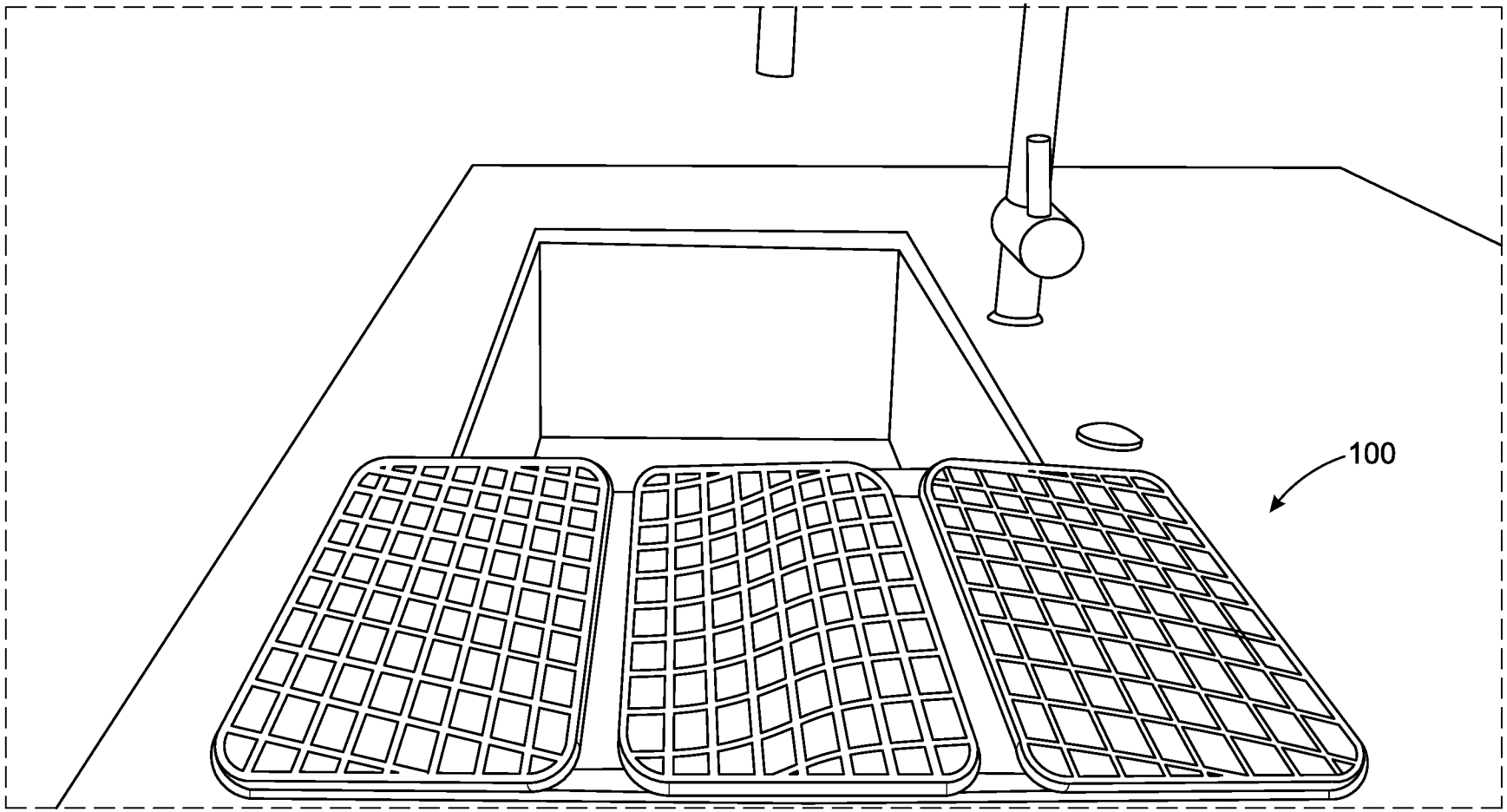
FIG. 2 illustrates a drying implement according to a first embodiment laid upon a countertop and adjacent to a sink.
Figure 3:
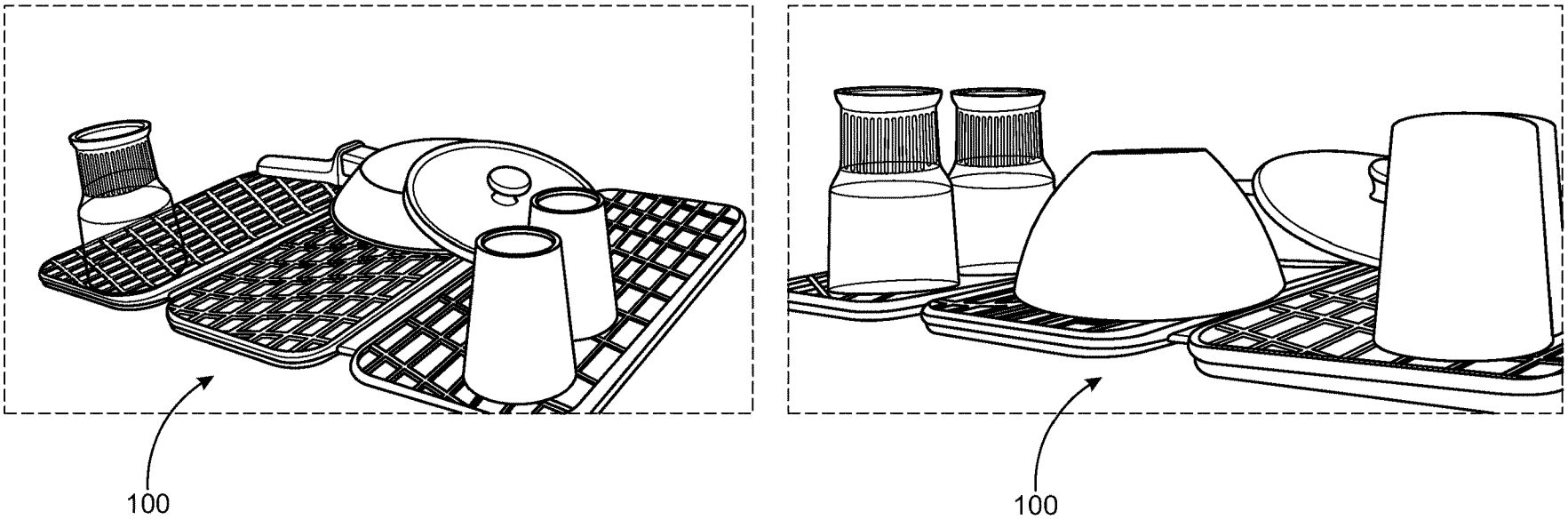
FIG. 3 illustrates the drying implement with dishes disposed thereon.
Figure 4:
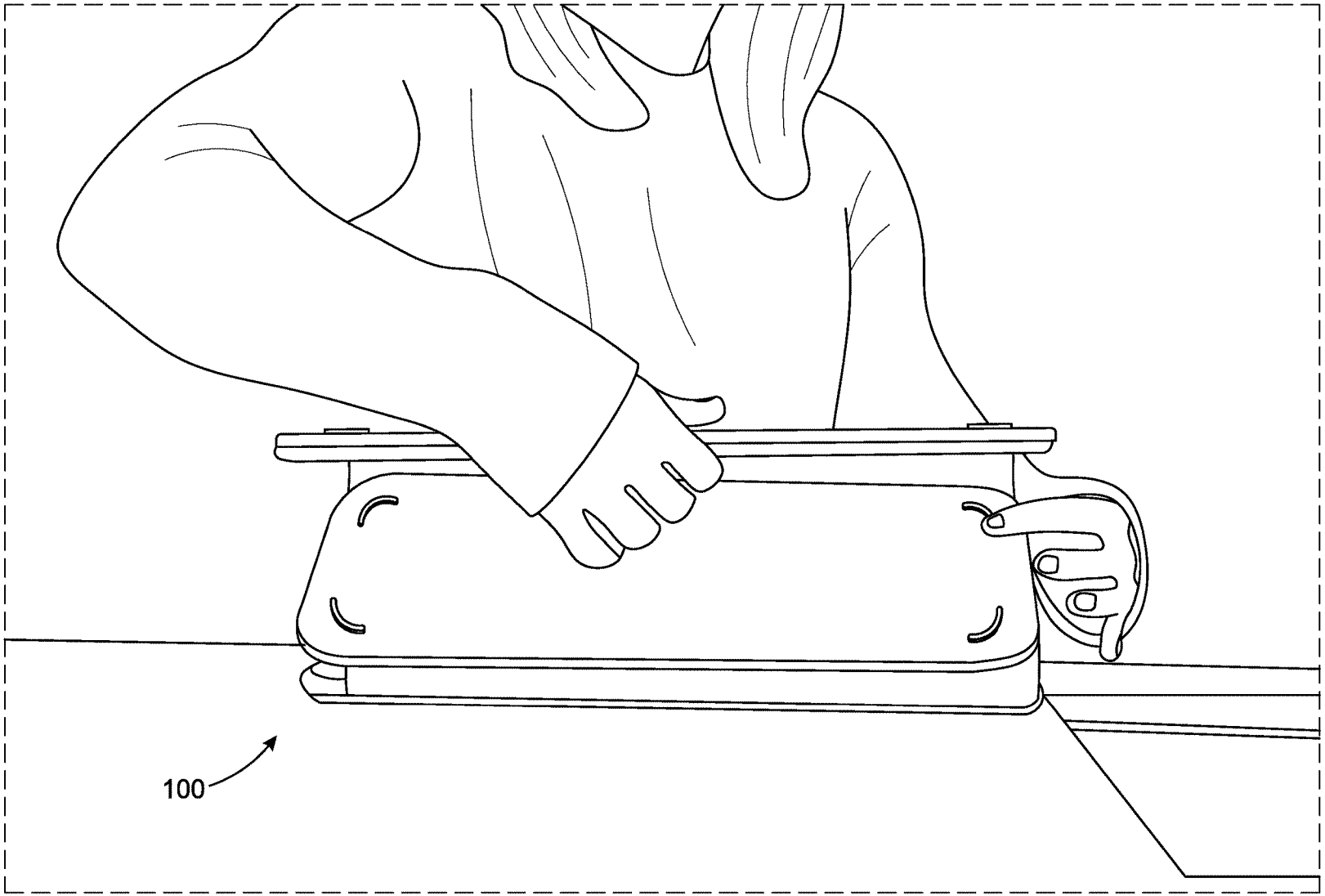
FIG. 4 illustrates the drying implement being folded after use.

Referring to FIG. 2, an example of a drying implement 100 is shown. The drying implement 100 is in an unfolded state and placed proximate to sink. Referring to FIG. 3 the drying implement 100 is shown with various dishes placed thereon for drying. And, FIG. 4 shows the drying implement 100 being folded into a compact configuration shown in FIG. 5 from both a top and bottom perspective. As can be appreciated by a comparison of FIGS. 2-5 the utility of the foldable drying implement 100 is drastically increased due to its ability to be quickly used to absorb the drain water from the dishes while being versatile in the way it is foldable to a collapsed position.

Figure 5:
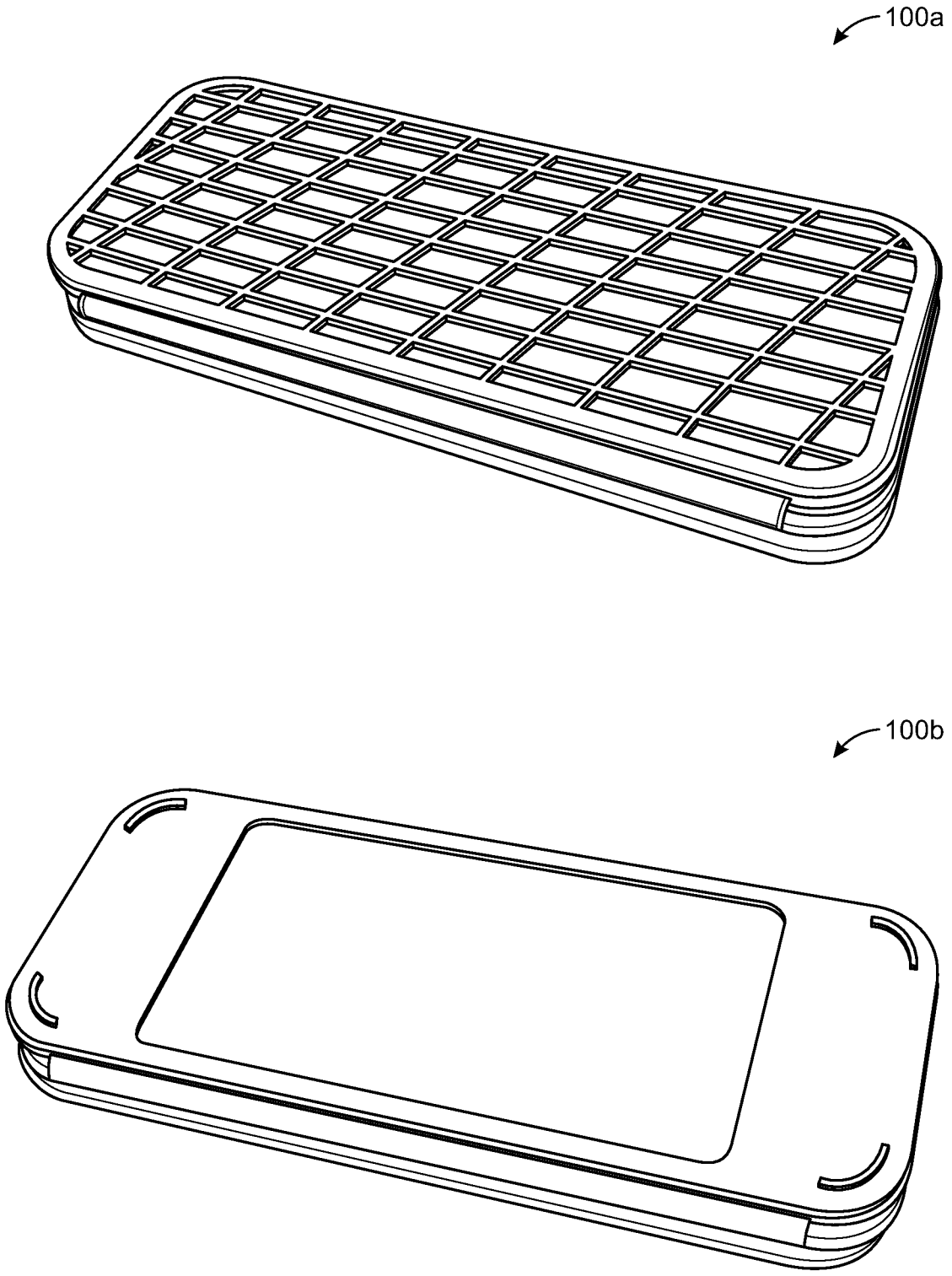
FIG. 5 illustrates the drying implement in the folded state both from a top view and a bottom view.

FIG. 4 illustrates a fold pattern where one side panel is folded inside of the opposite side panel and on top of the center side panel. FIG. 5 illustrates an embodiment where the panels of the drying implement 100 are folded in a "Z" folding pattern where a center panel is folded upon a left side panel and a right side panel is folded over the center panel.

Figure 6:
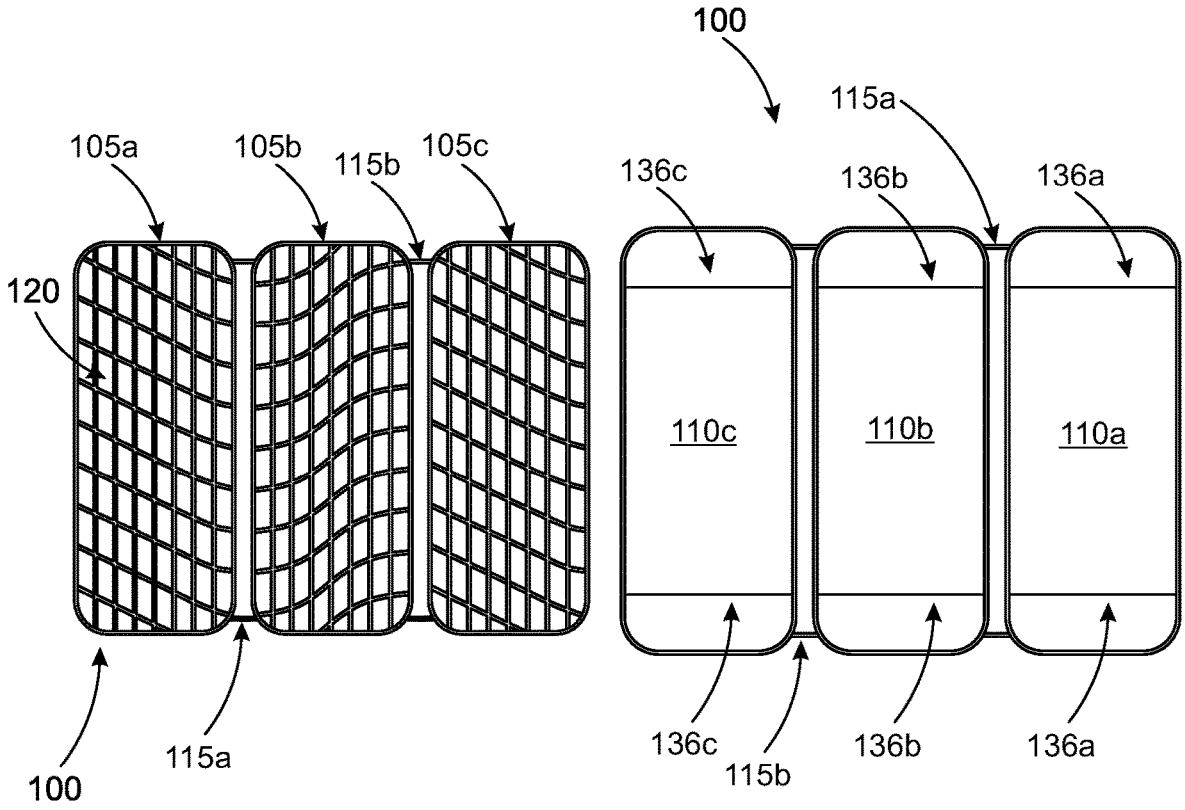
FIG. 6 illustrates the drying implement from a top and bottom view.
Figure 7:
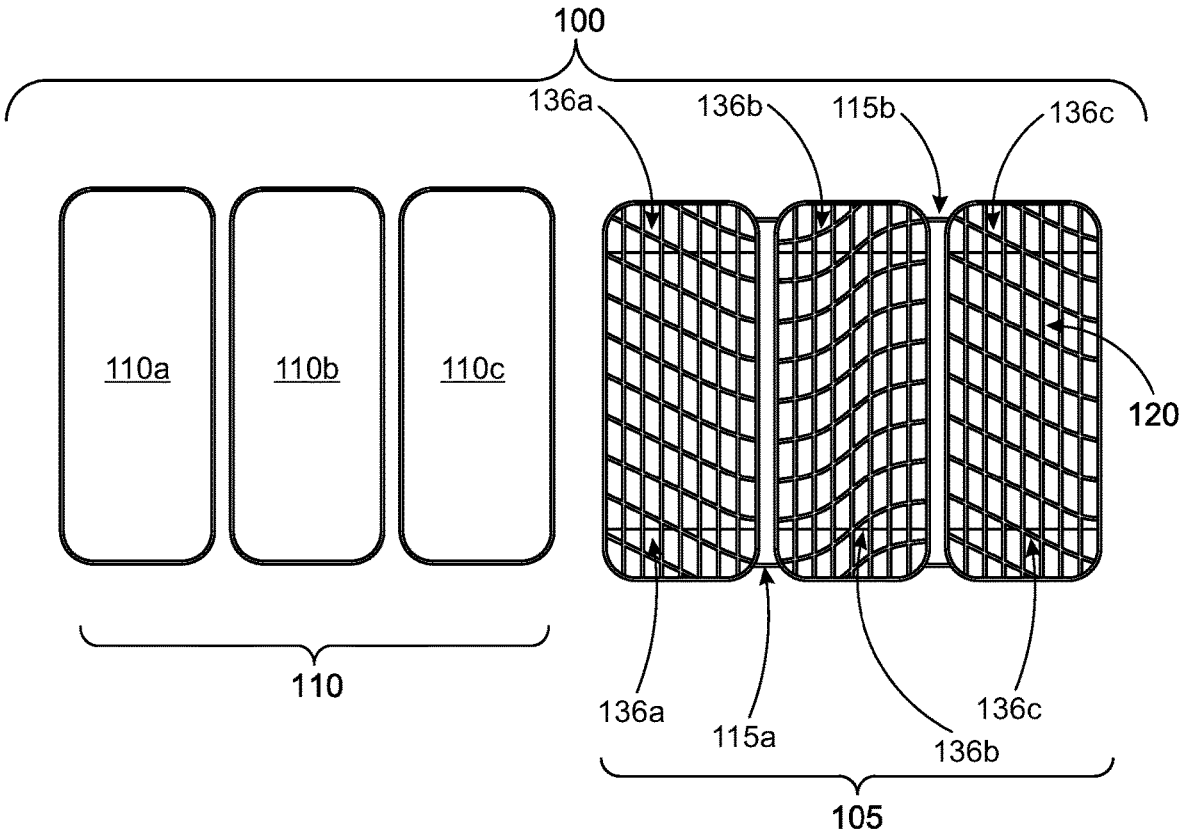
FIG. 7 illustrates the drying implement in an unassembled state.
Figure 8:
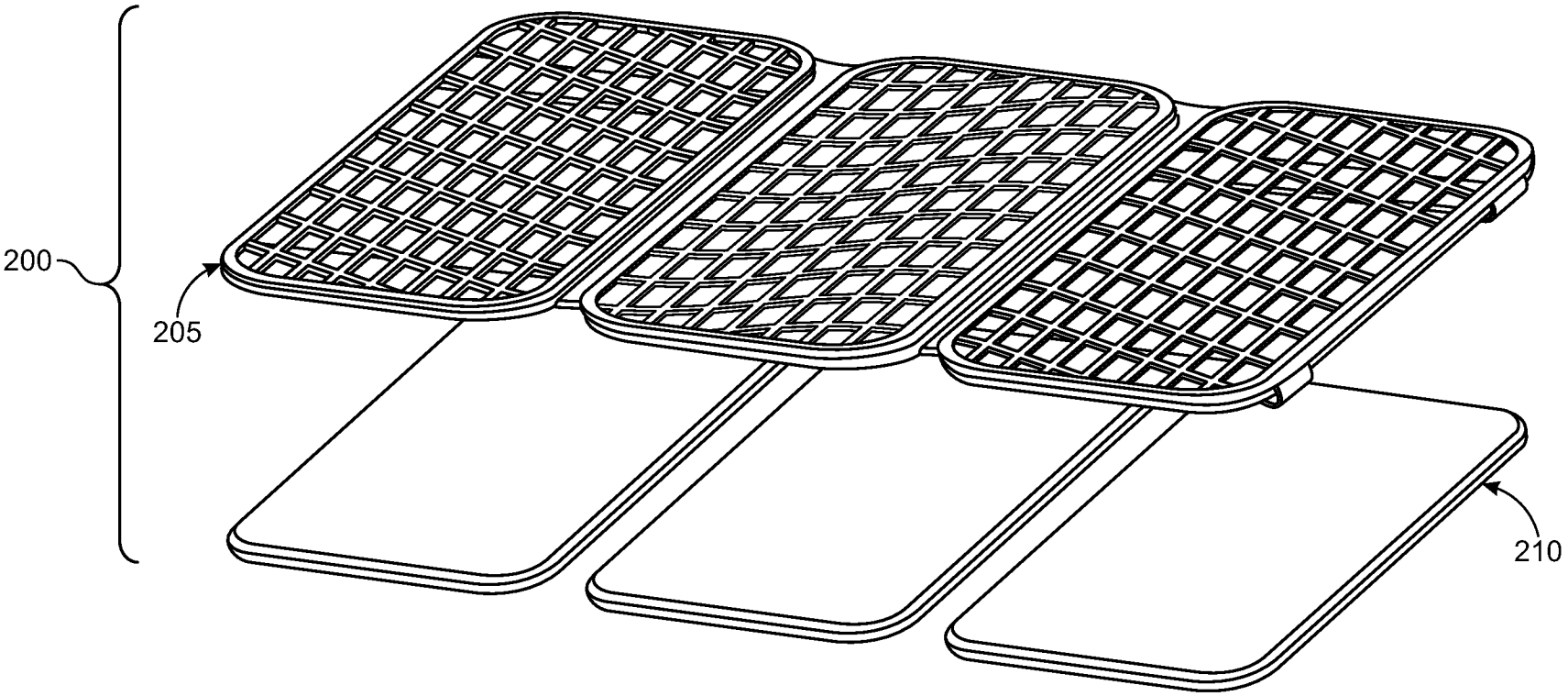
FIG. 8 illustrates a second embodiment of a drying implement in a disassembled state.

FIG. 6 illustrates the first embodiment of the drying implement 100 including a substantially resilient and flexible layer 105 and a plurality of substantially rigid absorption layers in the form of one or more absorption panels 110. FIG. 7 illustrates the drying implement 100 with the panels 110 disassembled from the flexible layer 105. As illustrated in FIGS. 6 and 7, the drying implement 100 can include three sections including a first section 105*a* of the resilient flexible layer 105, a second section 105*b* of the resilient flexible layer 105, and a third section 105*c* of the resilient flexible layer. Corresponding to the sections of the resilient flexible layer 105, the substantially rigid absorptive layer 110 can include three sections including a first section panel 110*a* of the absorptive layer 110, a second section panel 110*b* of the absorptive layer 110, and a third section panel 110*c* of the absorptive layer 110.

The resilient layer 105 can be formed of a molded polymer, such as a compression molded or liquid silicon molded silicone material so as to protect the kitchenware placed thereon. In some embodiments, the inventors of this patent application have found that LSR molding results in less flashing of material especially in the locations of voids 120, for example. The resilient layer 105 can be divided into sections connected by one or more flexible and foldable regions 115 there between. For example, as shown in FIG. 6, the three sections 105*a*, 105*b*, and 105*c* of the resilient layer 105 and be joint to adjacent sections by a connective joint 115. As shown in FIGS. 6 and 7, the first section 110*a* of the resilient flexible layer 110 is connected to the second section 110*b* by a first flexible joint 115 of the first flexible layer 110. The second section 110*b* is connected to the third section 110*c* of the flexible layer 110 by a second flexible joint 115.

The resilient layer 105 can include upper and lower pockets 136 for securing end portions of the lower layer 110 to the upper layer 105. The pairs of end pockets 136*a*, 136*b*, and 136*c* secure an outer periphery of the individual absorptive panels 110*a-c* respectively. And, the individual absorptive panels 210*a-c* are inserted into and held by the end pockets 136*a*, 136*b*, and 136*c* onto a bottom of the resilient upper layer 205. The pockets 236 can be formed integral and molded with the upper layer of the resilient layer 205.

Figure 9:
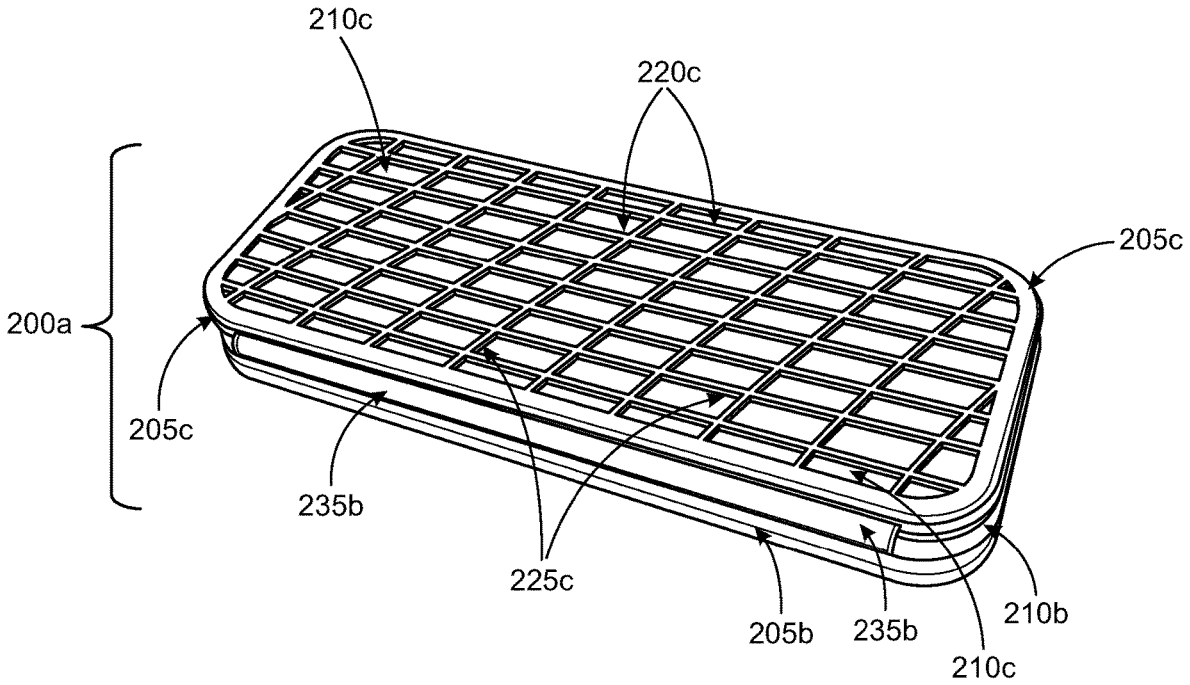
FIG. 9 illustrates the second embodiment in a folded state.
Figure 10:
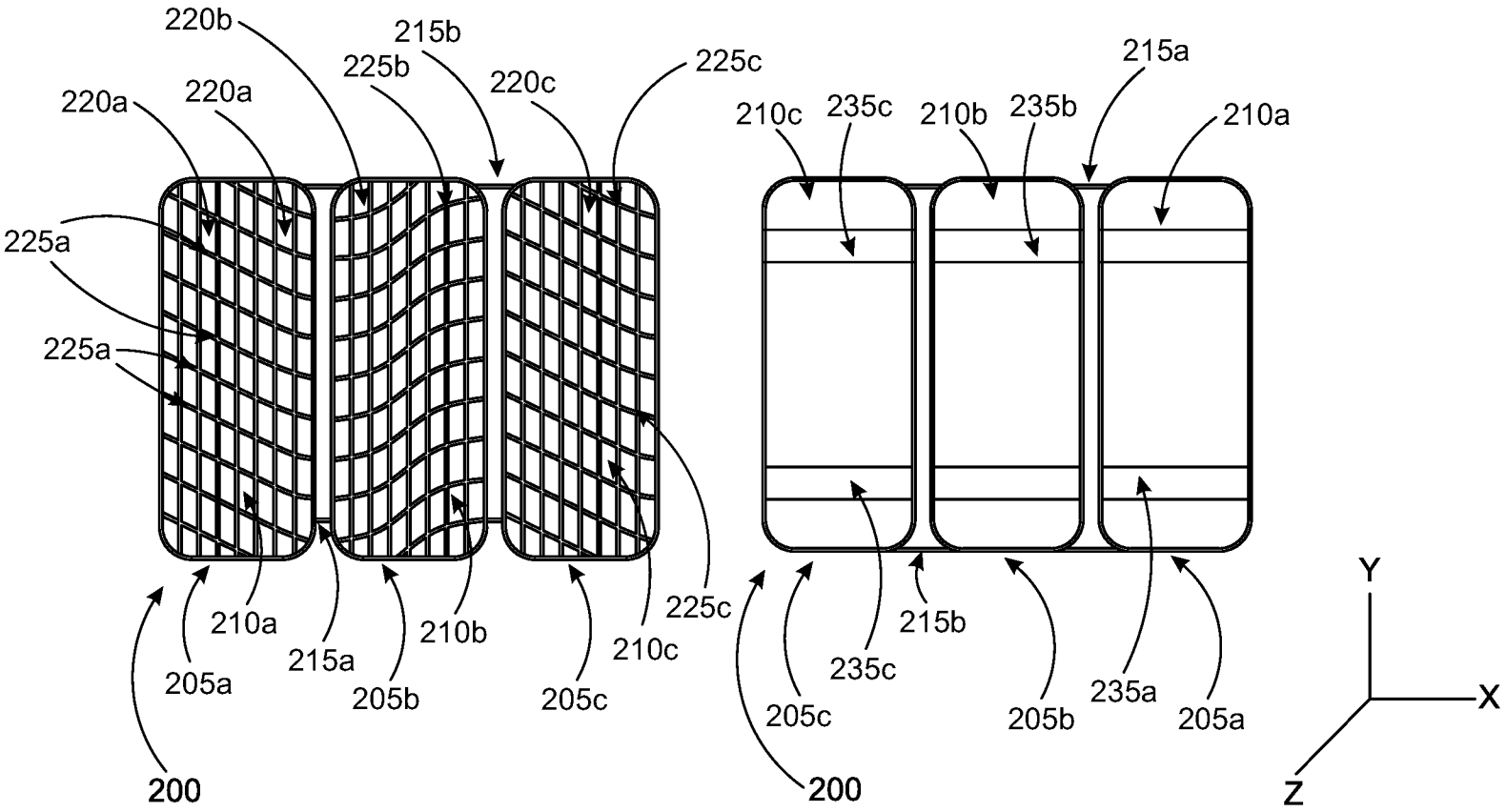
FIG. 10 illustrates the second embodiment from a top view and a bottom view.

Referring to FIGS. 8-12 a second embodiment of a drying implement 200 is shown. The drying implement 200 includes a plurality of absorption panels 205 and a flexible layer 210 having a plurality of sections corresponding to the absorption panel. The sections 205*a-c* of the resilient layer 205 can include a plurality of voids 220, pores, perforations, or slots that are molded, cut, or otherwise formed there through allow for water to drip through the sections of the resilient layer 205*a-c* to the panels 210*a-c* of substantially rigid absorption material 210. The size of the voids 220*a-c* corresponding to sections 205*a-c* can be selected for allowing for the moisture to drip onto the absorptive layer 210. For example, the sections 205*a-c* of the resilient flexible layer 205 can have ribs or partitions 225 separating and defining the voids 220. The arrays of ribs or partitions 225 can extend along an X direction and Y direction as shown in FIG. 10. The ribs or partitions 125 can also have a depth or thickness extending in the Z direction.

Figure 11:
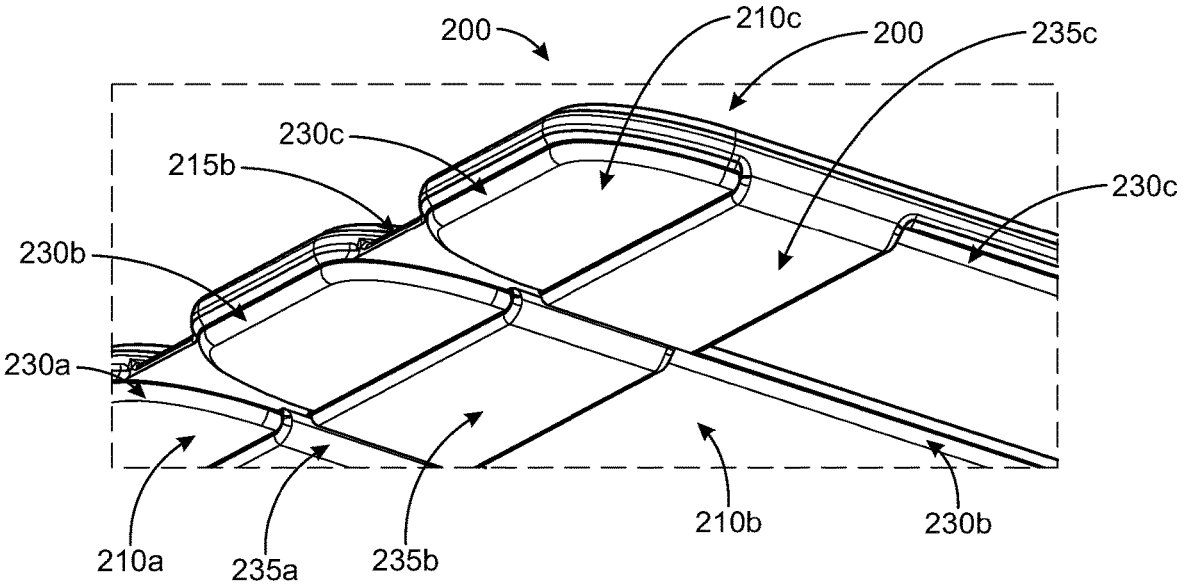
FIG. 11 shows the second embodiment from two perspective views.
Figure 11:
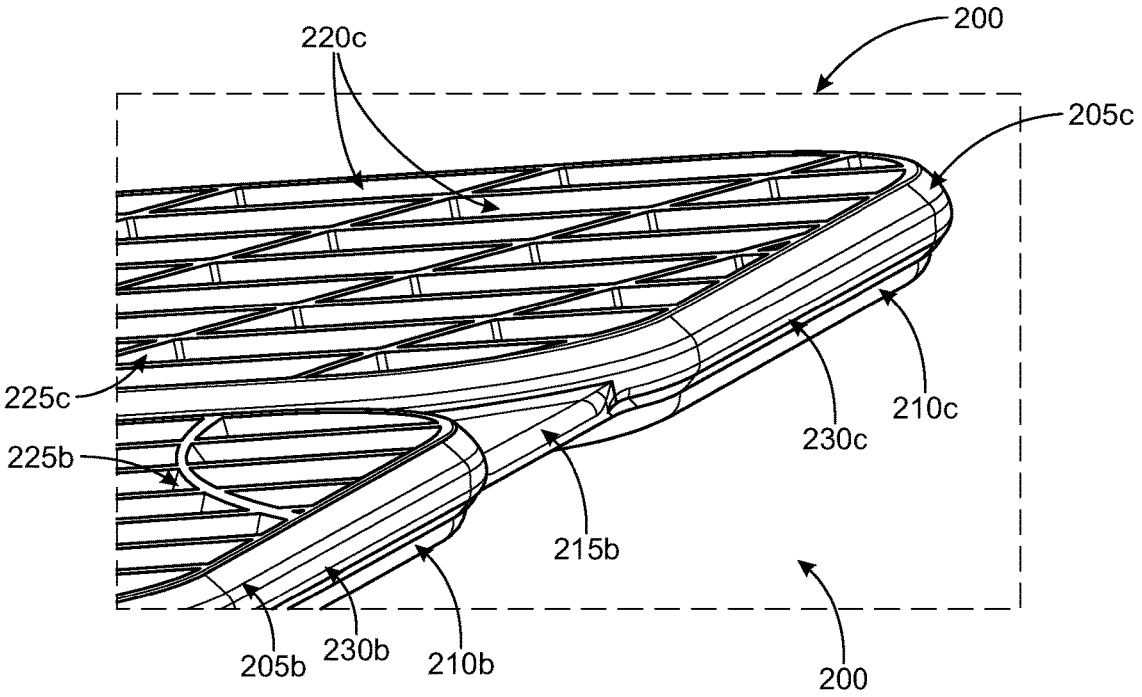

Referring to FIG. 10, the resilient layer 205 can include lower circumferential end caps 236 according to the second embodiment for securing end portions of the absorptive panels 210 to the flexible upper layer 205. As shown in FIG. 11, lips 230*a-c* secure an outer periphery of the individual absorptive panels 210*a-c* respectively. And, the individual absorptive panels 210*a-c* are inserted into and held by the straps 135*a-c* in the second embodiment and end caps or sleeves 126 according to the first embodiment onto a bottom of the resilient upper layer 205 and 105 respectively. According to the embodiment shown in FIGS. 6 and 10, end caps 136 and the straps 235 can be formed integral and molded with the upper layer of the resilient layer 105 and 205, respectively.

Referring to FIG. 9, the second embodiment of the drying implement 100, for example for drying kitchenware, is shown in a folded state. The third substantially resilient and flexible layer 205*c* is shown as a top layer folded upon a second layer 205*b* of the drying implement 200. The third panel 225*c* is shown retained by the lips of the third section 205*c* of the substantially resilient layer 205. The first and second sections 205*b* and 205*c* are connected by joints 215*b* as shown in FIG. 11. The ribs 225*c* and voids 220*c* are of the third section 205*c* of the resilient flexible layer 205 are shown. The drying implement 200 can be folded into the state shown in FIG. 9 for storage and can be unfolded back into the state shown in FIG. 10 for use. The folded state of the drying implement for kitchenware shown in FIG. 8 can also be used for drying kitchenware.

Figure 12:
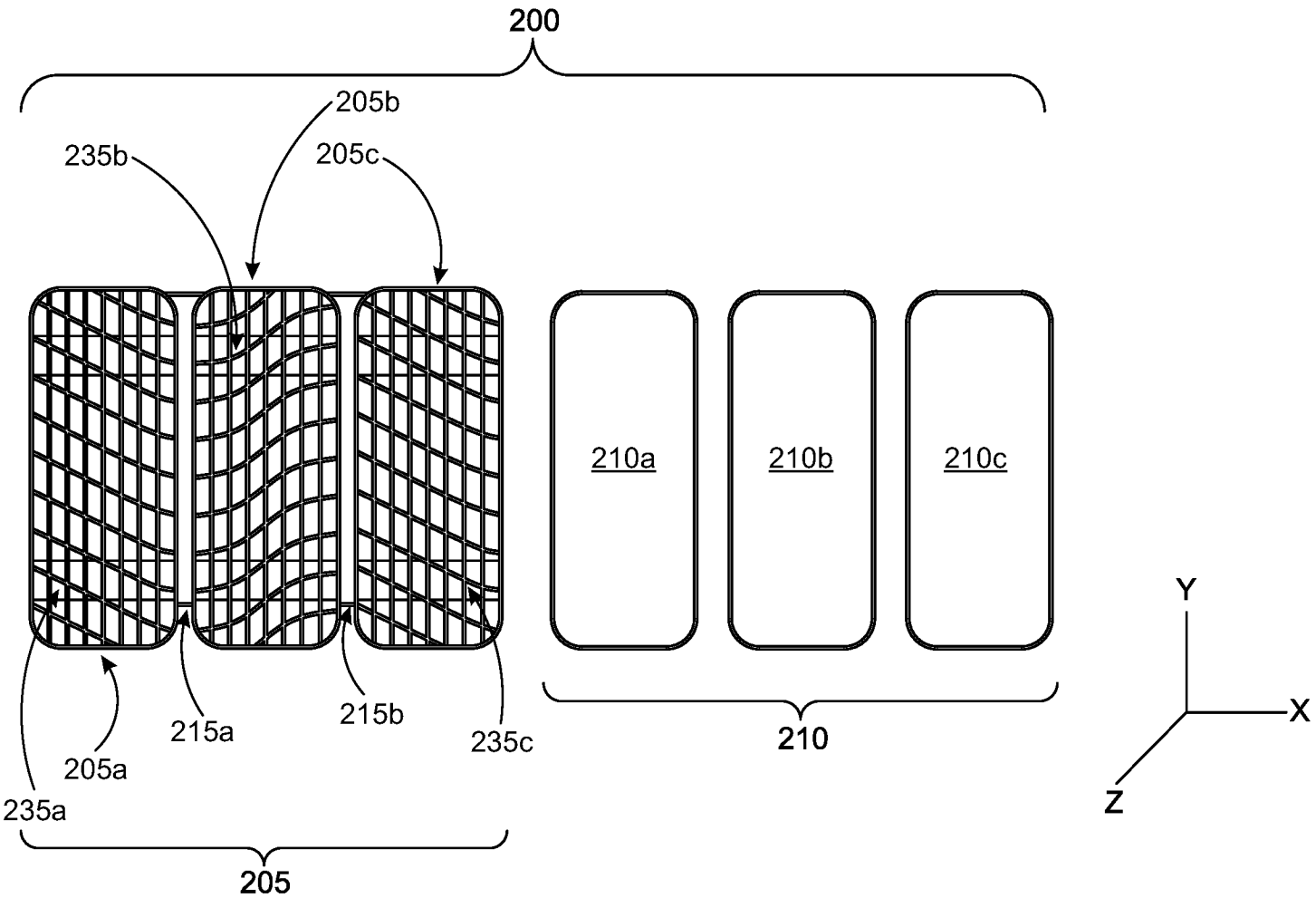
FIG. 12 shows the second embodiment in a dis-assembled state.

FIG. 12 illustrates the substantially flexible layer 205 disassembled from the substantially absorptive layer 210 of the drying implement 200. As shown, the absorptive sections 205*a*, 205*b*, and 205*c* in the form of substantially rigid panels comprising diatomaceous earth can be assembled with and dis-assembled from the corresponding sections 205*a*, 205*b*, and 205*c* of the substantially rigid layer 205 comprising a polymer material such as molded silicone.

Figure 14:
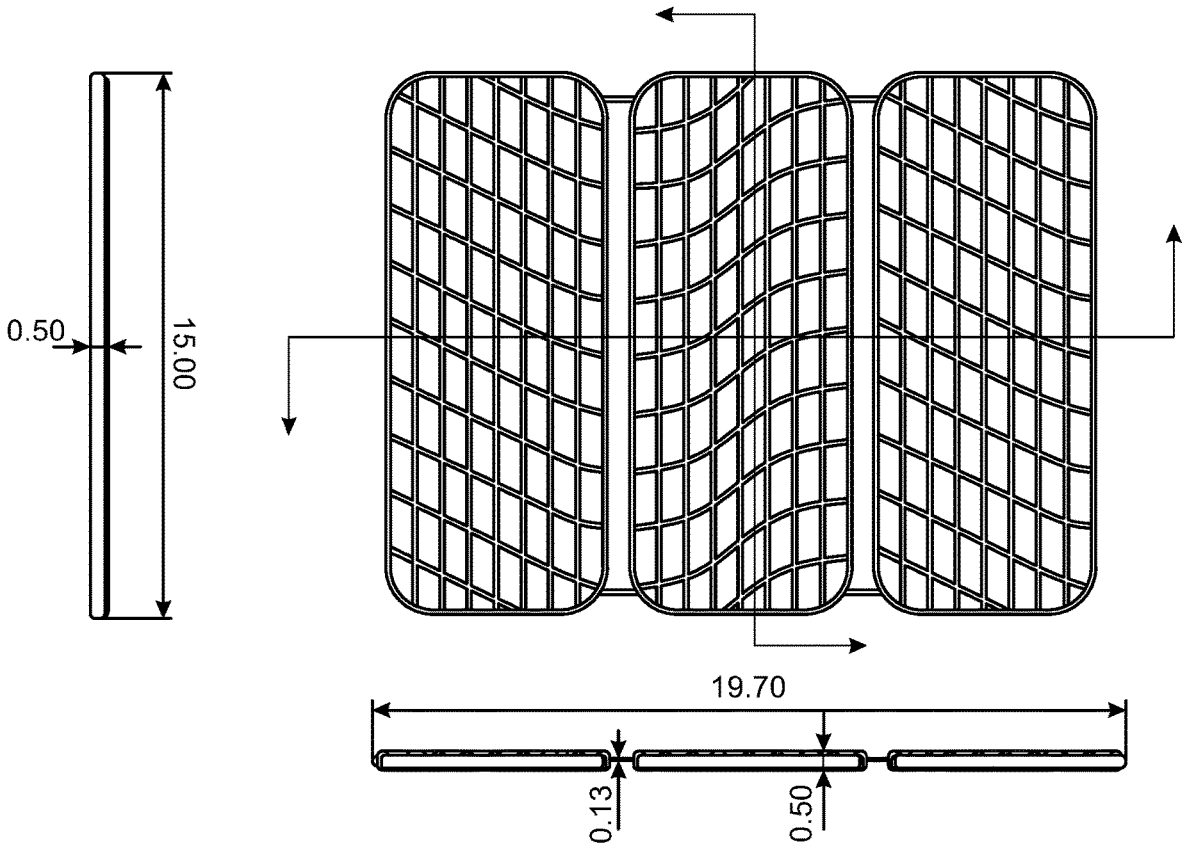
FIG. 14 illustrates two cross-sectional views including examples of thickness, length, and width dimensions thereof in inches.

Assembly of the panels 205*a*, 205*b* and 205*c* can include insertion of the panels 205*a*, 205*b* and 205*c* into the respective sleeves 235*a*, 235B, and 235C of the respective sections 205*a*, 205*b*, and 205*c* of the substantially resilient layer 205. The sections 205*a*, 105*b*, and 105*c* being connected by the joints 115*a* and 115*b*. Some examples of materials and dimensions of a drying implement 100 and 200 including a substantially resilient and flexible layer 2 and an absorption layer 1 according to an embodiment of the disclosed invention are illustrated in FIG. 14. Referring again to FIG. 12, the second example of the drying implement 200 is shown including a substantially resilient and flexible layer 205 and a plurality of substantially rigid absorption panels 210.

Figure 13:
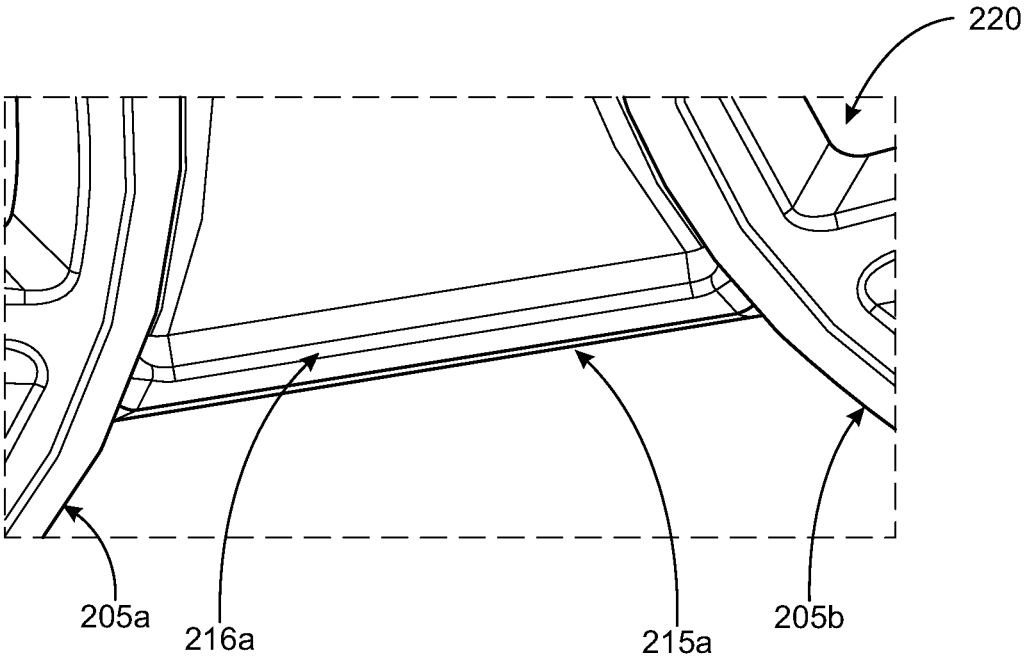
FIG. 13 provides a close-up of a joint between adjacent sections of the drying implement.

The second embodiment 200 illustrated has the size and shape of the joints 215 recessed from just one of the flexible layer 205 as further illustrated in FIG. 13. The resilient layer 205 can be formed of a molded polymer, such as a compression molded or LSR silicone material and can be divided into sections connected by the one or more flexible and foldable region 215 there between. As previously discussed, in some embodiments, the inventors of this patent application have found that LSR molding results in less flashing of material especially in the locations of voids 220 and 220, for example. For example, as shown in FIG. 12, the three sections 205*a*, 205*b*, and 205*c* of the resilient layer 105 be connected to adjacent sections by a connective joint 115. As shown in FIG. 12, the first section 205*a* of the resilient flexible layer 205 is connected to the second section 205*b* by a first flexible joint 215*a* of the first flexible layer 205. The second section 205*b* is connected to the third section 205C of the flexible layer 205 by a second flexible joint 215*b*. Example dimensions can include: Length: 19.91 inches/50.57 cm, Width 15.21 inches/38.63 cm, Height: 0.52 inches/1.32 cm. Additional dimensions are illustrated in FIG. 14. The inventor have found that 45 durometer silicone pad that slips around panels is preferable in some embodiments depending on the application. Thickness of panels can be 0.35 inches radius 0.12 inches on ends. Length can be about 20 inches and width is about 15.25 inches. Each panel can be about 15 inches in width and 6 inches in length as shown in some embodiments. Three panels and one silicone rubber pad may be used as shown, however according to other embodiments, a single panel and silicone rubber panel or any number thereof may be implemented.

Referring to FIG. 13, a close-up view of joint 215*a* is shown having an upwardly extending lip 216*a* for retaining water upon the joint 215*a* and substantially preventing the water from spilling onto a countertop disposed there under during use. The lip remains foldable at the joint as previously discussed and shown and water is allowed to dry on the silicone joint in such embodiments.

Thus, the embodiments disclosed herein provided rapid drying of dishes or other articles that are subjected to repeated saturation or wet environments while providing for a resilient soft surface for kitchenware as well as replaceable and collapsible components thereof.

One skilled in the art will appreciate that, for this and other processes and methods disclosed herein, the functions performed in the processes and methods may be implemented in differing order. Moreover, the structures of apparatus may be reorganized or variated used to accomplish a given feature or function. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It is understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.).

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, quadrants, thirds, etc. As a non-limiting example, each range discussed herein can be readily broken down into a lower third, middle third and upper third, etc. As will also be understood by one skilled in the art all language such as "up to," "at least," and the like include the number recited and refer to ranges which can be subsequently broken down into subranges as discussed above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A drying implement, comprising:

a rigid absorption panel that comprises diatomaceous earth; and a covering that (i) is flexible and resilient; (ii) is configured to at least partially and removably encase the rigid absorption panel; and (iii) has a top surface, side edges and at least one of a bottom lip, a pocket or a strap;

wherein the at least one of the bottom lip, the pocket or the strap is configured to secure the covering to the rigid absorption panel; and the top surface comprises a mesh of ribs that form a plurality of apertures that are configured to allow liquid to drain from an object disposed on the covering, through the apertures, to the rigid absorption panel.

2. The drying implement according to claim 1, further comprising a second rigid absorption panel that comprises diatomaceous earth; wherein the covering comprises a first portion that is configured to at least partially and removably encase the rigid absorption panel and a second portion that is configured to at least partially and removably encase the second rigid absorption panel; the second portion comprising a second top surface, second-portion side edges, and at least one of a second-portion bottom lip, a second-portion pocket, or a second-portion strap; wherein the at least one of the second-portion bottom lip, the second-portion pocket or the second-portion strap is configured to secure the second portion to the second rigid absorption panel; and the second top surface comprises a second-portion mesh of ribs that form a plurality of second-portion apertures that are configured to allow liquid to drain from an object disposed on the second portion, through the second-portion apertures, to the second rigid absorption panel.

3. The drying implement according to claim 1, wherein the covering is formed from a molded polymer material.

4. The drying implement according to claim 3, wherein the molded polymer material comprises a molded silicone material.

5. The drying implement according to claim 2, wherein the first portion is connected to the second portion by a flexible joint that is configured to enable the first portion to be folded onto the second portion.

6. The drying implement according to claim 1, wherein the apertures of the covering include voids having a width of about 0.75 inches.

7. The drying implement according to claim 1, the covering partially extending around top, sides, and bottom of the rigid absorption panel.

8. The drying implement according to claim 7, the covering including protrusions extending from a bottom thereof that are configured to support the drying implement above a surface on which it is disposed to facilitate air circulation underneath the rigid absorption panel.

9. The drying implement according to claim 5, wherein the flexible joint comprises an upwardly extending lip that is configured to retain liquid on the flexible joint rather than allowing it to spill onto a surface on which the drying implement is disposed.

10. A drying implement, comprising:

a silicone covering that is configured to support just-washed kitchenware while the kitchenware is drying, the silicone covering comprising a plurality of sections, each section having a top kitchenware-contacting surface that includes a plurality of apertures therethrough, which apertures are configured to allow liquid to drain from the just-washed kitchenware and through the apertures; and a plurality of absorption panels comprising diatomaceous earth at least partially and removably encased by the silicone covering, the plurality of absorption panels configured to absorb the liquid drained from the kitchenware, through the apertures.

11. A drying implement, comprising:

a first panel and a second panel, each of the first panel and second panel being rigid and absorptive and comprising diatomaceous earth; and a covering that is flexible and resilient, the covering having a first section that is configured to at least partially and removably encase the first panel, and a second section that is configured to at least partially and removably encase the second panel; each of the first section and second section having a top surface, side edges and at least one of a bottom lip, a pocket or a strap;

wherein the at least one of the bottom lip, the pocket or the strap is configured to secure the first panel to the first section and the second panel to the second section; and wherein each of the top surface of the first section and the top surface of the second section comprises a mesh of intersecting ribs that form a plurality of apertures therethrough.

12. The drying implement of claim 11, wherein the first section extends around a top and sides and partially around a bottom of the first panel; and the second section extends around a top and sides and partially around a bottom of the second panel.

13. The drying implement of claim 11, wherein the covering comprises a molded polymer material.

14. The drying implement of claim 11, wherein the covering comprises a silicone having a durometer hardness of between 30 and 60.

15. The drying implement of claim 11, further comprising a flexible joint that (i) couples the first section and the second section, and (ii) is configured to enable the first section to be folded on top of the second section.

16. The drying implement of claim 15, wherein the flexible joint comprises an upwardly extending lip that is configured to retain a quantity of liquid on the flexible joint, when the first section and second section are disposed on a surface.

17. The drying implement of claim 11, wherein the at least one of the bottom lip, the pocket or the strap comprises protrusions extending therefrom that are configured to support the drying implement above a surface on which it is disposed to facilitate airflow between the drying implement and the surface.

18. A drying implement, comprising:

a first panel, a second panel and a third panel, each of the first panel, second panel and third panel being rigid and absorptive and comprising diatomaceous earth; and a covering that is flexible and resilient, the covering having a first section that is configured to at least partially and removably encase the first panel, a second section that is configured to at least partially and removably encase the second panel, and a third section that is configured to at least partially and removably encase the third panel;

wherein the first section and second section are joined by a first flexible joint, and the second section and third section are joined by a second flexible joint; and wherein the first flexible joint and second flexible joint are configured to enable the second section to be stacked on the first section and the third section to be stacked on the second section;

wherein each of the first section, second section and third section has a top surface, side edges and a bottom pocket; wherein the bottom pocket of the first section is configured to secure the first panel to the first section, the bottom pocket of the second section is configured to secure the second panel to the second section, and the bottom pocket of the third section is configured to secure the third panel to the third section; and wherein each of the top surface of the first section, the top surface of the second section and the top surface of the third section comprises a mesh of intersecting ribs that form a plurality of apertures therethrough.

19. The drying implement of claim 18, wherein at least one of the bottom lip or the pocket of each of the first section, second section and third section comprises protrusions extending therefrom that are configured to support the drying implement above a surface on which it is disposed to facilitate airflow between the drying implement and the surface.

20. The drying implement of claim 18, wherein the mesh of intersecting ribs defines apertures having a width of about 0.75 inches.

21. The drying implement of claim 18, wherein the covering comprises a molded silicone having a durometer hardness of between 30 and 60.

22. The drying implement of claim 18, wherein each of the first flexible joint and second flexible joint comprises an upwardly extending lip that is configured to retain a quantity of liquid on the same.

* * * * *